US005144990A

United States Patent [19]

Spoeler et al.

[11] Patent Number: 5,144,990

[45] Date of Patent: * Sep. 8, 1992

[54] SWITCH IN OVERHUNG RAIL SYSTEMS

[75] Inventors: Johannes-Gerhard Spoeler, Borken; Manfred Grapentin, Herdecke, both of Fed. Rep. of Germany

[73] Assignee: Mannesmann A.G., Düsseldorf, Fed. Rep. of Germany

[ * ] Notice: The portion of the term of this patent subsequent to Nov. 8, 2003 has been disclaimed.

[21] Appl. No.: 628,595

[22] Filed: Aug. 21, 1984

[51] Int. Cl.[5] ..... F01B 25/06

[52] U.S. Cl. ..... 104/130

[58] Field of Search ..... 104/130, 89, 102, 111, 104/96, 106

[56] References Cited

U.S. PATENT DOCUMENTS

| | | | |
|---|---|---|---|
| 1,379,614 | 5/1921 | Bennington | 104/130 |
| 3,735,709 | 5/1973 | Matsumoto et al. | 104/130 |
| 3,927,619 | 12/1975 | Bradley | 104/130 |
| 4,938,150 | 7/1990 | Gustav et al. | 104/130 |

FOREIGN PATENT DOCUMENTS

| | | | |
|---|---|---|---|
| 2158265 | 5/1973 | Fed. Rep. of Germany | 104/130 |
| 2218373 | 10/1973 | Fed. Rep. of Germany . | |
| 2129593 | 5/1990 | Japan | 104/130 |
| 2133755 | 8/1984 | United Kingdom | 104/130 |

*Primary Examiner*—Robert J. Oberleitner
*Assistant Examiner*—Mark T. Le
*Attorney, Agent, or Firm*—R. H. Siegemund

[57] ABSTRACT

The switch is of universal construction to accomodate different rail patterns, and includes a parallelogram shaped turn over plate having three corners affixed to stationary rails and journalling rollers for a motor driven switch frame which carries a curved and a straight section; the chord of the curved section has an angle of 90° to the displacement direction and the straight section has an angle of 77.5° to the displacement direction.

13 Claims, 4 Drawing Sheets

SWITCH IN OVERHUNG RAIL SYSTEMS

BACKGROUND OF THE INVENTION

The present invention relates to a displacable rail slide, including a straight rail section mounted to a frame for through travel and a curved rail section for branching and including rail connecting facilities, for connecting a stationary frame to the ends of stationary rails; the latter frame guides the displacable frame of the switch.

Such a switch is disclosed for example in German printed patent application 22 18 373. The construction is such, that for each type of switch separate and special parts have to be provided for, which means, that on one hand the inventory variety increases while the number of particular parts to be made for an overall system generally is reduced, which from an overall point of view increases also mounting assembly time and matters become correspondingly expensive. Inventory when needed in large varieties, becomes likewise disproportionately expensive.

DESCRIPTION OF THE INVENTION

It is an object of the present invention to provide a new and improved displacement switch of the type referred to above, i.e. having straight and curved sections, and a moveable and a stationary guiding frame.

It is therefore another object of the present invention to provide a new and improved displacement switch, which is more economical, particularly as far as manufacturing costs is concerned, as compared with the prior art switches.

In accordance with the preferred embodiment of the present invention, it is suggested to provide guiding for the displacement frame to run in a particular direction, which includes an angle of about 90° to the chord of a curved rail portion for a 45° angle of the curved rail section, the angle of the displacement direction of the switch amounts to 90° minus half of 45°, for a total of 77.5° angle in relation to the straight rail section of the switch; the direction of switch displacement thus coincides with the angle bi-sector of the 45° angle, and therefore will always run to similar oblique ends of the straight rail portion and of the stationary rails not being the branch line. Depending upon the purpose of use and assembly the angle relationship remains the same for a large variety of different circumstances. This means then, that all of the various parts for all kinds of displacement switches, will have a high degree of commonality and are therefore subject to manufacture in large numbers, which is economic indeed.

In furtherance of the invention, the guiding rails for the displacement frame of the switch, run in a frame constructed as a turn over plate; suitable rollers are journalled on that turnover plate. The turn over plate is a planar metal plate or flat frame which depending upon the type of switch, is used with one or the opposite surface as upper surface as far as assembly is concerned. Thus, depending upon the desired condition, the same type of plate can be used with one side up or the other side up correspondingly simple mounting. Also always the same straight or curved rail sections can be used, and one can readily see, that all kinds of different types of displacement switches can be produced and manufactured by this fashion with a simple set of inventory. The guide portion, i.e., the guide rails of the displacement frame have horizontal carrier surfaces for load carrying rolls which are suitably mounted at the turn over plate; vertical guiding surfaces for the guiding rails are engaged by particular guide rolls which are also journalled to the plate. The turnover plate may moreover be provided with slide grooves for screws, bolts or the like.

In furtherance of the invention, the ends of the stationary rail portions, either the straight ones or the curved branch ones are provided with carrier or bearing surfaces, on which can be placed support surfaces of the end of the straight and of the curved rail section, respectively pertaining to the slide frame. Due to this kind of support, the weight of the displacement switch and of vehicles running thereon, are directly transmitted to the adjoining stationary rails. This is in contradistinction with the heretofore common practice wherein these loads and weights are reacted completed into the switch construction and the forces are then transmitted into the support frame for the rail equipment. The direct transmission of load forces into the stationary adjoining rail permits the utilization particularly of the previously mentioned light weight and relatively easy to make turnover plate as connecting frame. The displacement frame with its guide rails serves only for guiding of the rail section during adjusting the switch and is free from loads of such as, for example, trolleys or the like which will not pass across the switch during adjustment!

The ends of the rails and of the rails sections are preferably provided with end pieces respective one of which has a slot and the other one a pin that may project into the slot. Adjoining abutting surfaces of slot and pin are particularly surface finished for ease of sliding displacement of the switch.

The previously mentioned turnover plate is in accordance with another feature of the present invention, provided with particular connections to the stationary rails: and here bores and/or circular segment type slots are provided for foot plates of c-shaped rail mounting facilities. The stationary rail is respectively fastened to the other arm of this c-shaped mounted structure, i.e., at the end opposite the aforementioned foot plate.

The foot plate of the mounting facility, may likewise be provided with circular segment shaped slots, which may agree with the slots in the turn over plate. The slot in the foot plate may deviate from the slots in the turn over plate to a degree determined by an eccentric indexing pin. There are provided all together four segment shaped slots, each of which covering an arc of about 45°, and thus permits mounting of the rail mounting facility in any possible angle in relation to the turnover plate. This means that there is a large variety of mounting possibilities as far as the various rail equipment is concerned and which does not require any particular finishing work at the installation site; rather, all of the various parts are available and the different situations are simply accommodated by different mounting orientation. This of course is particularly of interest if subsequently the system is to be changed for any reason.

In furtherance of the invention, a switch motor or drive is connected to the turnover plate and linked to the slide and displacement frame through a crank drive. The crank drive is connected to the displacement frame through a joint and adjusting facility. A damping or attenuating spring may be associated with the adjusting device, in order to compensate any forces that may tend to act between the crank and f.ex. a stop member on the displacement switch.

DESCRIPTION OF THE DRAWINGS

While the specification concludes with claims particularly pointing out and distinctly claiming the subject matter which is regarded as the invention, it is believed that the invention, the objects and features of the invention, and further objects, features and advantages thereof will be better understood from the following description taken in connection with the accompanying drawings, in which:

Figure 1:
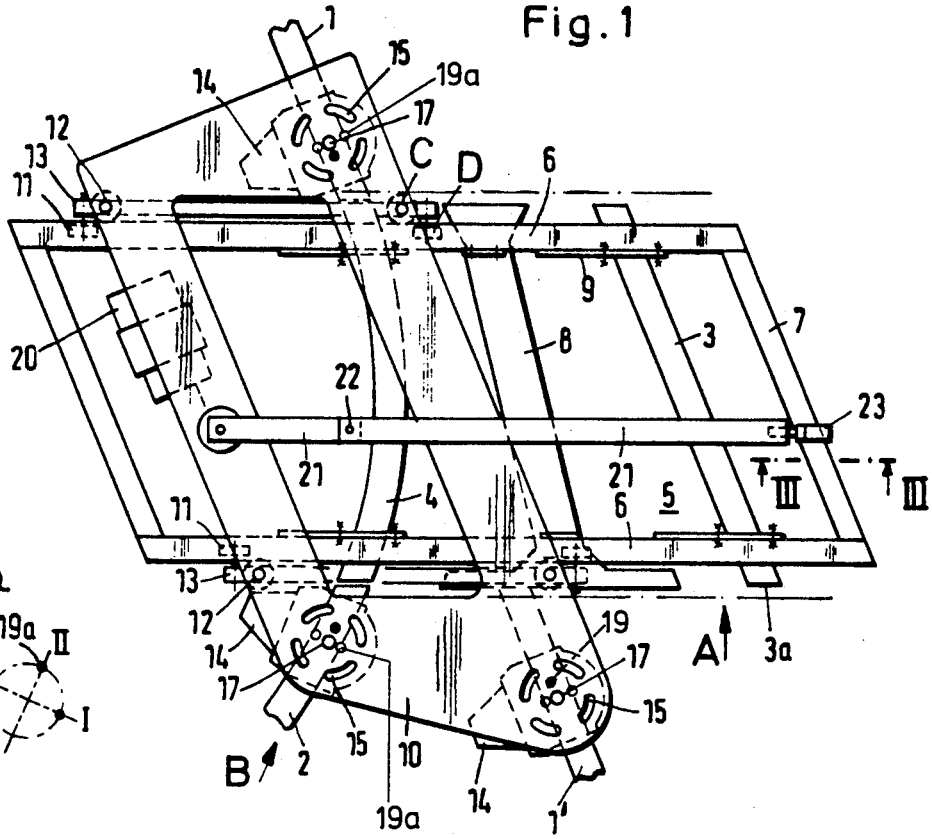
FIG. 1 is a top view of a displacement switch, constructed in accordance with the preferred embodiment of the present invention for practicing the best mode thereof.

Proceeding now to the detailed description of the drawings, the upper portion of FIG. 1 shows an end portion of a straight stationary rail 1 of a tract for overhung trolleys or the like, which rail track is continued in the lower portion by likewise a straight stationary rail portion 1'. These two rail portions are aligned. A straight rail section 3 can be shifted into alignment with and as mutual continuation of the two rails 1 and 1'. The switch moreover shows additionally a curved rail section 4 which can with one end be aligned with the rail section 1 and at the same time, its other end will be aligned with a rail section 2 in the lower left hand portion of FIG. 1, serving for example as a branch line or the like.

As far as construction is concerned the slide switch includes a slide frame 5, having straight guide rails 6, which extend of course in the direction of slide displacement of the frame 5. The geometry of mounting can best be seen in FIG. 2. The two rail sections 3 and 4 are mounted on that frame 5. The two guide rails 6 are interconnected at its end with transverse bars or mounting rails 7 or the like, thus establishing the mounting, support and slide frame 5.

The displacement and slide frame 5 is constructed as a parallel-o-gram in that the traverses 7 extend parallel to the straight rail section 3. Frame 5 has additionally a central traverse carrier 8 which extends at right angles to rails 6 and oblique to the traverses 7. A rail mounting structure 9 is provided for suspending respectively the straight rail section as well as the curved rail section from the frame. See in this regard particularly FIG. 11.

Figure 11:
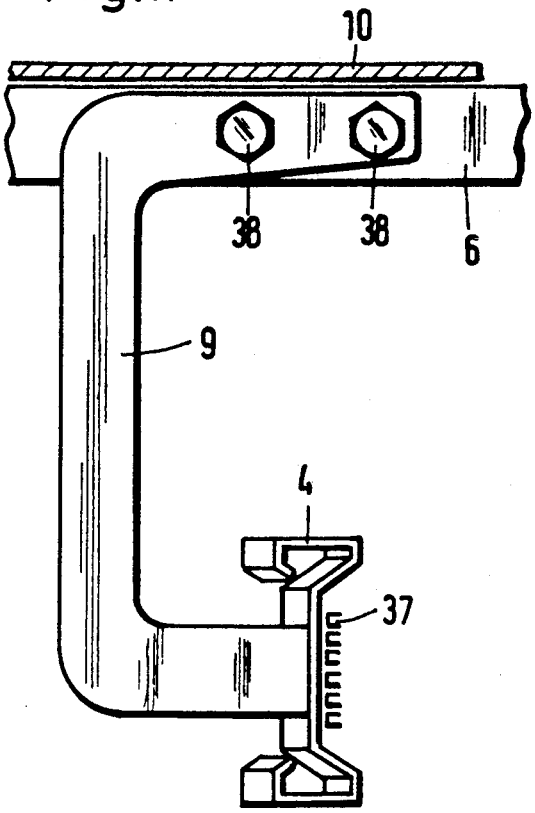
FIG. 11 and 12, 12*a* illustrate details A and B respectively as shown and indicated in FIG. 1, but also on an enlarged scale.

Turning therefore briefly to FIG. 11, the FIG. shows particularly a c-shaped rail mounting bracket 9, being with its upper leg portion connected to the rail guide 6 by means of bolts 38, while the rail section proper, in this case the curved section 4, is attached to the end of the lower arm of the c. Reference numeral 37 illustrates somewhat schematically conductors for engagement with contact making brushes or the like. Reference numeral 37 illustrates somewhat schematically conductors for engagement with contact making brushes or the like.

Returning to FIG. 1, the central cross bar element 8 is provided for preventing the vehicle from escaping from the rail. It should be observed that the vehicle is suspended from any of the rails 1,3,4, etc., and will of course run normally on the stationary rails 1 and 2. If for any reasons, such as a malfunction, the switch frame 5 has an intermediate position, i.e., neither rail section 3 nor rail section 4 is aligned with the rails 1, 1' or 2, then the cross element 8 avoids that the vehicle will tumble down.

Figure 9:
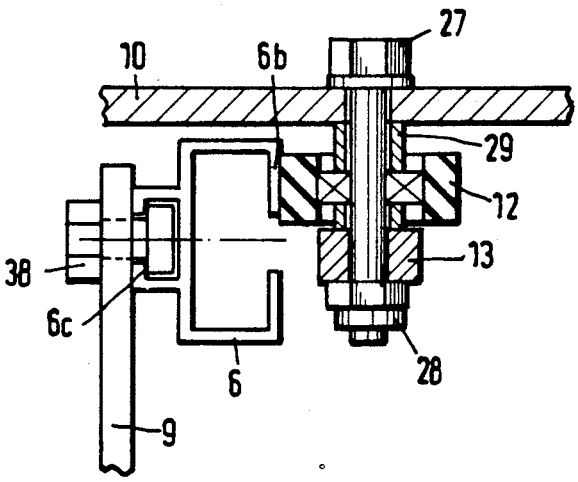
FIG. 9 and 10 respectively illustrate details C and D shown in FIG. 1 but in enlarged scale.
Figure 10:
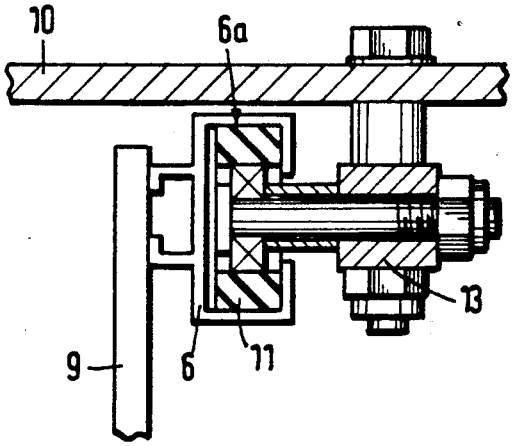

The slide frame 5 as stated has lateral guide rails 6 and by means of carrier rolls 11 and guide rolls 12, the displaceable frame is supported under a turn over plate 10. Details of this suspension are more readily discernible from FIG. 9 and 10. A guide rail 6 has an upper horizontal load carrying surface 6*a* for carrier rolls 11, and next to the surface 6*a* is a guide surface in form of an overhang portion 6*b* for engagement with guide rolls 12. The guide rolls 12 are directly journalled to the turn over plate 10, under utilization of a bolt 27 and nut 28, and under interpositioning of a spacer sleeve 29. The load carrying roll 11 is bolted to the turn over plate 10 through a roll bearing journal 13. A slide in nut 6*c* is provided for bolts 38 (FIG. a). These bolts run in this groove generally and permit sliding of any of the mounting brackets 9 or of the center transverse carrier 8 in relation to the rail 6 for adjustment purposes. Normally elements 6, 8, and 9, are of course secured to each other and they constitute parts of the slide frame 5 of the switch.

Figure 3:
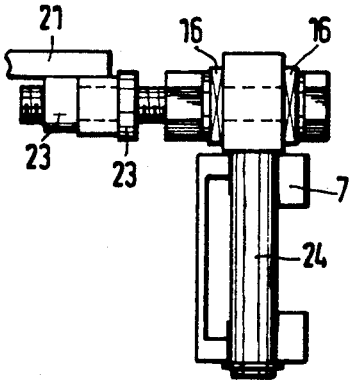
FIG. 3 is a section along taken along line III—III as indicated in FIG. 1, but being drawn to a larger scale.

The turn over plate 10 carries the switch frame driving motor 20. A crank drive 21, having a joint 22, connects the motor 20 to a joint pin 24, there being an adjusting structure 23, with spring 16 interposed. The joint pin 24 is mounted and connected to the transverse member 7 of the slide frame 5. This connection is shown in greater detail in FIG. 3.

Figure 12:
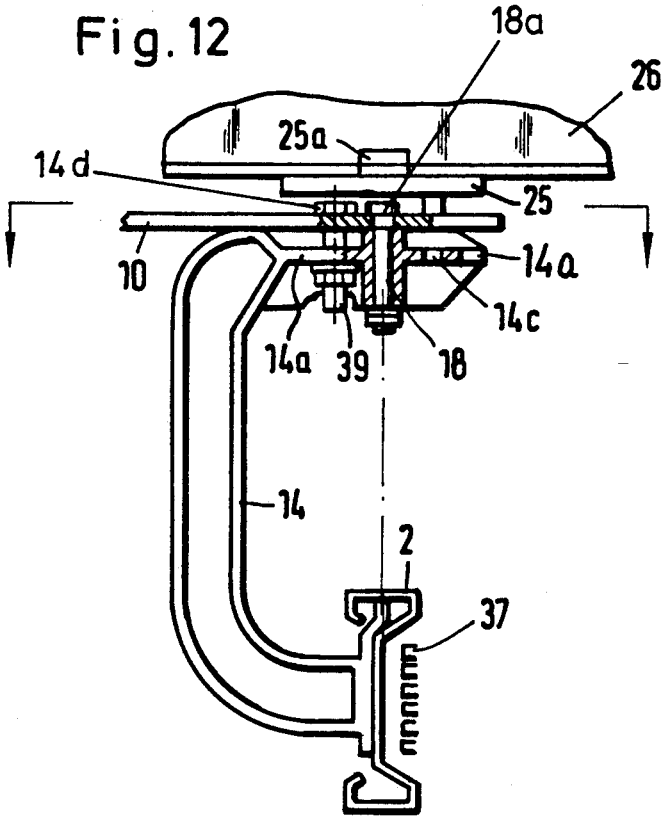
Figure 12A:
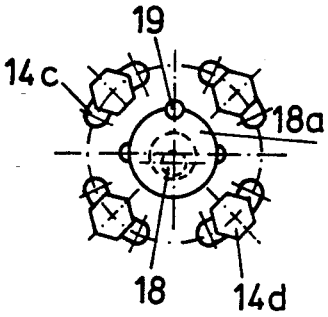

FIG. 1 illustrates moreover essential details of the turn over plate 10 having connect points and locations for the rail bracket and mounting elements 14, at the ends of the straight rails 1, 1' and the branch rail 2. The turn over plate 10 is provided on three corners with four circular segment shaped slots 15 to be located at the connect points of the plate to the stationary rails. Each of these segment type slots covers an angle of about 45°. There are similarly shaped slots 14 C in the foot portion 14 a of the rail mounting structure 14 (FIG. 12 and 12*a*), by means of which the orientation of the turn over plate can be varied so as to accommodate different types of switches, particularly as far as directions of branching and continuation is concerned. The slots 14*c* deviate radially from the pattern of slots 15 so as to accommodate eccentricities indexed by pin 18.

Figure 1A:
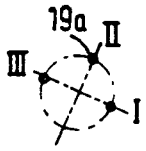
FIG. 1*a* is a detail of FIG. 1.
Figure 4:
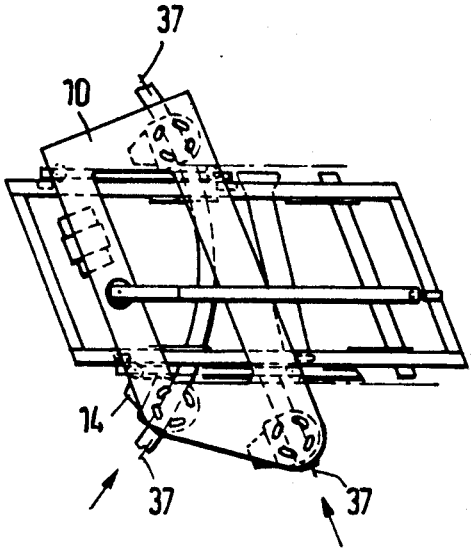
FIG. 4, 5, 6, and 7 illustrate the same switch in different positions and different modes of adjustment.
Figure 5:
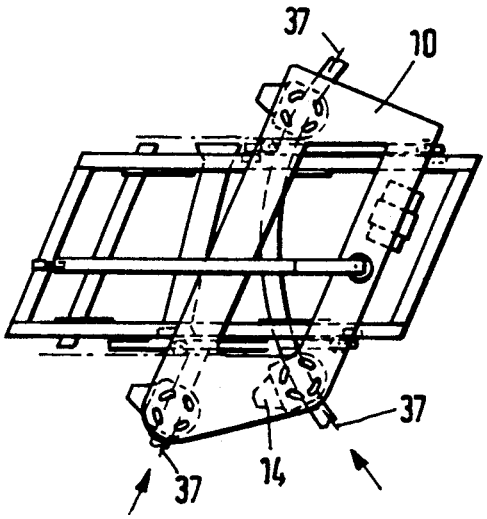
Figure 6:
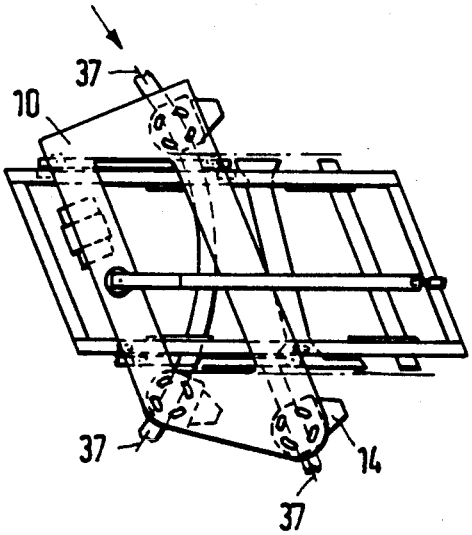
Figure 7:
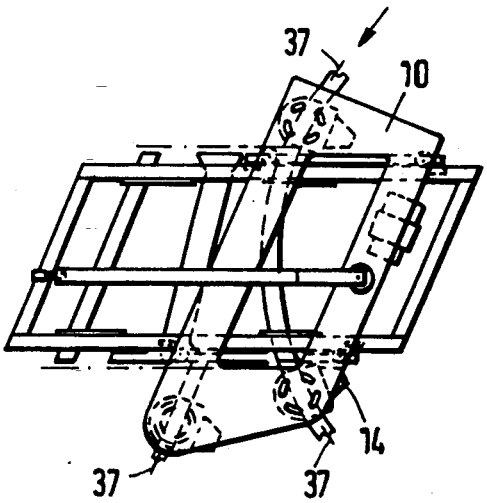
Figure 8:
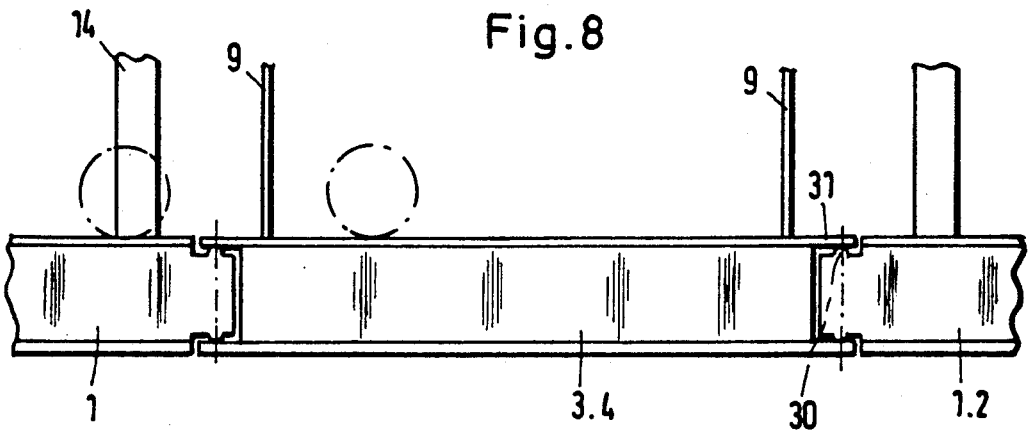
FIG. 8 is a side elevation of the suspension of a displacement switch.

The turn over plate 10 has three centering bores 17 each in the center of the circle of arcuate slots 15 and respectively for receiving eccentric indexing pins 18. This way one adjusts very accurately the disposition of the respective rail mounting structure, c-bracket 14 at the connection with the rails 1, 1' and 2. In other words this arrangement of bores 17 and indexing pins 18 will adapt the particular fastening of the turn over plate to the exact location of the ends of the rails 1, 1' and 2, as they actually occur in a given rail system. The indexing pins 18, will then be positioned through clamping pins 19. The clamping pins 19, will be received by one of the three bores 19*a* as shown in FIG. 1*a* to be seen in an enlarged view in the lower left hand portion of FIG. 1. The turn over plate 10 has three bores 19*a* in each of the three corners of the plate to which a bracket 14 is fastened. These bores are arranged on a circle for receiving the clamping and locking pin 19. The bore in position I, will be used if the switch arrangement and placement is such as shown in FIG. 5 and 7. The position II will be used if the switch in fact provides only for straight through connection and the position III will be used when the plate 10 has actually been used upside down as compared with the arrangement of FIG. 5 and 7, which arrangement is shown in FIG. 4 and 6, showing branching in a different direction. The arrows in FIG. 4 through 7 show the direction of the one way travel. The c-shaped brackets (FIG. 11, 12) require that the trolley suspension on the rails be on one side only and that dictates the geometry!

Turning back to FIG. 12 it illustrates further details of the c-shaped mounting bracket and structure 14, e.g. for the branch track 2. The bracket and foot portion 14*a* is to be connected to the turn over plate 10 through appropriate connectors 25*a* and the clamping plate 25, which in turn connects these parts to a carrier 26. These carriers may for example be portions of a load carrying roof construction as for example are found in large manufacturing halls and they will be simultaneously part of the carrier construction for such an overhung vehicle system. The foot 14*a* of the rail bracket 14 is connected by means of pins and bolts 39 to the clamping plate 25. The turnover plate 10 is situated on the foot 14*a*. The disposition of the various rail mounting brackets 14, in relation to each other is determined through the three points I, II, and III, as far as locking the indexing pin 18 is concerned.

Figure 2:
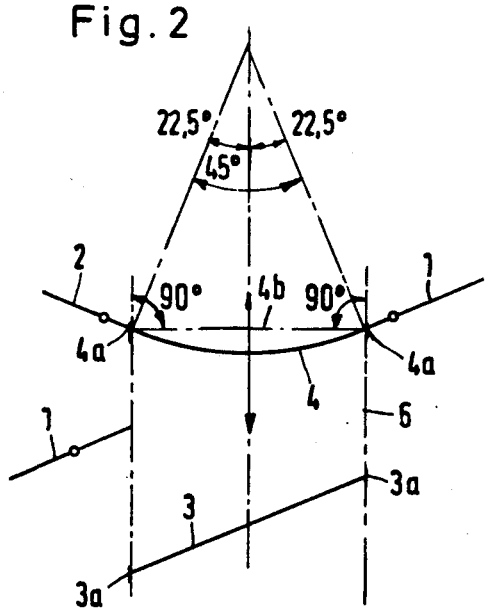
FIG. 2 is a diagram for explaining the relevant geometric factors involved in the operation of the switch.

The geometry involved is depicted further and in greater detail in FIG. 2. One can see that section planes 3*a* and 4*a* of the straight track section 3 as well as for the curved section 4 in parallel and include the direction of extension of the guide rails 6, which of course establishes the direction of switch displacement. Thus, their geometry will not be changed if they are in fact turned over, or if in a different configuration the switch is rotated as a whole by 180 degrees. This then means, through such simple change the various geometries as illustrated in FIGS. 4, 5, 6, and 7, can be accommodated.

FIG. 2 illustrates moreover a 90° angle between the chord 4*b* of the curve section 4 on one hand and the direction of extension of the guide rail 6, along which the slide frame is adjusted. Moreover FIG. 2 illustrates that the angle of the straight sections 1, 1' to the direction of sliding is 90° minus half of the curve angle of the section 4, the curve angle is 45° half of that angle is 22.5° which means that the straight section 1 or 1' relative to the section of sliding has an angle of 77.5°. This geometric relation is maintained throughout and remains valid regardless of the particular configuration chosen.

As stated, FIGS. 4, 5, 6 and 7 illustrate the same or the same kind of turn over plate 10, but in different geometric relationships as far as overall track patterns are concerned, but the geometry and the angular relationships, as outlined above remain basically the same. The difference between the arrangement as per FIG. 4 and FIG. 6, is in the disposition of the rail mounting structure 14, for the rails; because the curved portion of the c-shaped structures 14 must always be to the left of the rail. The mounting bracket pattern must remain the same and must remain consistent throughout the system.

As was mentioned above, the lower arms of these c-shaped mounting structures 14 carry the rails proper and the rails themselves carry the slide conductors for engaging the current collecting brushes. Thus, the FIGS. 4 and 6, on one hand or 4 or 5 or 7, merely differ merely in the orientation of the mounting bracket.

The invention is not limited to the embodiments described above, but all changes and modifications thereof, not constituting departures from the spirit and scope of the invention, are intended to be included.

We claim:

1. Slide switch for rail systems, there being stationary rails and branch rails to be interconnected by the switch, comprising:

a slide frame on which are mounted a straight rail section and, spaced therefrom in a direction of displacement, a curved rail section;

guide means for said slide frame to provide for a direction of displacement of the slide frame, being oriented in relation to a chord of the curved section by an angle of approximately 90°, so that an angle between said direction of displacement as defined by the guide means, in relation to the straight section is 90° minus half of the angle of said curved section; and adjustable stationary mounting means for holding complementary guide means, cooperating with the guide means on the slide frame to obtain slide displacement of said slide frame, along said direction and relatively to the adjustable stationary mounting means.

2. Switch as in claim 1, wherein said stationary mounting means is a turn over plate like mounting frame.

3. Switch as in claim 2, wherein said guide means for said slide frame includes a pair of guide rails, with means for guiding and supporting rolls, said latter rolls constituting the complementary guide means of said turn over plate and being journalled thereon.

4. Slide switch as in claim 3, there being rolls having horizontal axes to provide support for the slide frame, there being additional rolls having vertical axes for purposes of guiding the guide rails in relation to the turn over plate, the guide rails being provided correspondingly with horizontal and vertical engagement surfaces.

5. Slide switch as in claim 1, there being ends of said stationary rails being provided with support surfaces for immediate and direct engagement of overlapping end portions of the curved and straight sections on the slide frame.

6. Slide switch as in claim 2, said turn over plate being provided with means for connection to the stationary rails, the means for connection including a c-shaped rail mounting bracket having a stationary rail mounted to a lower arm, while an upper arm is adjustable mounted to the turn over plate.

7. Switch as in claim 6, wherein said turn over plate is connected to said stationary rails through c-shaped brackets, the stationary rails being affixed to the lower arm of the c, the turn over plate being secured to the upper arm of the c under utilization of an indexing pin and circular arc shaped slots in said upper leg for angularly and lateral indexing the orientation of the c shaped bracket to the turn over plate.

8. Switch as in claim 6, wherein the upper arm of the c has a foot plate, the circular arc shaped slots being in the foot plate, there being circular arc shaped slots in the turn over plate, there being indexing means for correlating angular positions of these slots.

9. Switch as in claim 8, wherein the circular arc shaped slots deviate radially in order to accommodate eccentric disposition of the indexing means.

10. Switch as in claim 2, said turnover plate including a drive motor, there being a transmission including a crank drive, provided and interconnecting said motor with said slide frame.

11. Switch as in claim 10, wherein said crank drive is connected to the slide frame via a joint and attenuating spring and an adjusting mechanism.

12. A slide switch to be interposed between stationary rails comprising:

a frame plate, connected to said stationary rails through connecting points for different angular adjustment positions of each of the connecting points relative to the stationary rails;

guide rolling means suspended from the plate and defining a direction of movement which is angular with respect to each of said rails;

a rail section suspending frame being provided with a contour of a parallel-o-gram and having guide rail means for engaging said rolling means for being movable along said direction of movement; and a curved and a straight rail section on said rail section suspending frame, oriented so that one end of said curved section, and one end of said straight section extend parallel in the same direction, said curved section moreover being oriented and proportioned so that a chord between its ends has an angle of 90° relative to said direction of movement.

13. Slide switch as in claim 12, wherein said rolling means include rolls with horizontal and vertical axis, said guide rails means having correspondingly oriented surfaces for engaging said rolling means.

* * * * *